United States Patent [19]

Christo

[11] 4,377,879

[45] Mar. 29, 1983

[54] CLEANING DEVICE

[75] Inventor: Peter Christo, Memphis, Tenn.

[73] Assignee: Gem, Incorporated, Byhalia, Miss.

[21] Appl. No.: 333,564

[22] Filed: Dec. 22, 1981

[51] Int. Cl.[3] ..... A47L 13/24

[52] U.S. Cl. ..... 15/229 A; 248/74 PB

[58] Field of Search ..... 15/226, 228, 229 R, 15/229 A, 229 AC, 229 AP, 229 AW, 229 B, 229 BC, 229 BP, 229 BW; 248/74 PB

[56] References Cited

U.S. PATENT DOCUMENTS

| | | | |
|---|---|---|---|
| 1,762,454 | 6/1930 | Poulos | 15/229 AC X |
| 3,149,808 | 9/1964 | Weckesser | 248/74 PB |
| 3,431,576 | 3/1969 | Moss et al. | 15/229 R |
| 3,966,154 | 6/1976 | Perrault et al. | 248/74 PB |

*Primary Examiner*—Edward L. Roberts

*Attorney, Agent, or Firm*—Mason, Fenwick & Lawrence

[57] ABSTRACT

A cleaning device is disclosed as comprising a plurality of cleaning elements, a handle having a first end adapted to be manually graspable and a second end, and a connector comprising a hollow portion adapted for receiving the second end of the handle for securing the handle to said connector, a flexible securing tongue adapted to be disposed abut the cleaning elements, and at least one locking member for receiving the leading end of the securing tongue, whereby the securing tongue may be secured tightly to said connector.

9 Claims, 8 Drawing Figures

10
14
24
22c
22b
22a
12
27
16
18
20

10
12
24
27
20
16
26

20
16
10
14
12
18
22c
22b
26

CLEANING DEVICE

BACKGROUND OF THE INVENTION

Description of the Prior Act

This invention relates to cleaning devices in the nature of wet or dry mops, and in particular to connectors for assembling a handle to a plurality of cleaning elements or strings.

Cleaning devices such as mops are well known in the prior art. Such mops comprise a plurality of cleaning elements or strings made of a suitable absorbent yarn such as cotton which performs the cleaning function, a handle that is readily graspable by the mop's user and a connector whereby the cleaning elements are securely fastened to the handle. The design and configuration of a connector are important in terms of the structural security and the expectant life of the mop, as well as the manner in which the mop will function to clean either as a dry or wet mop. First, it is desired that the connector be made of a material other than metal, which has a tendency to scratch the surface to be cleaned. Further, metal connectors tend to rust or corrode thereby shortening the useful life of the mop. The connector should be easy and inexpensive to fabricate as well as to assemble in a manner whereby the cleaning elements are securely held to its handle. Further, the method of assembly should be a relatively simple, foolproof procedure. Mops of the prior art typically require a multipiece connector and must be provided in a variety of sizes to accommodate the desired range of the mop size, i.e. a range of numbers of cleaning elements.

U.S. Pat. No. 2,975,004 of Safianoff discloses a connection device for a dust mop made of a plastic material that has a cyclindrical portion for receiving a mop handle and a grasping head including a locking flange that secures a mop head to the handle. More specifically, the mop head includes a support frame comprising a pivot bar that is designed to be disposed within a cylindrical opening of the grasping head and retained thereto by the locking flange. Such a mop is relatively expensive requiring complex construction of the support frame and the cleaning strings or elements to a cloth pocket, which is in turn secured by the support frame to the connection device.

SUMMARY OF THE INVENTION

It is therefore an object of this invention to provide a new and improved cleaning device that is relatively inexpensive to manufacture and assemble, and in particular, that facilitates in a simple, foolproof manner the assembling of a plurality of cleaning elements to a handle.

It is a further object of this invention to provide a connector for a cleaning device that permits the securing of a range of numbers of cleaning elements to a handle.

It is a still further object of this invention to provide a new and improved connector for a cleaning device made of a material that will not rust or corrode and which will not scratch the surface to be cleaned.

In accordance with these and other objects of this invention, there is disclosed a cleaning device comprising a handle readily graspable by the device's user, and a connector for assembling in a secured fashion a plurlity of cleaning elements or strings to the handle. The connector includes a portion to receive one end of the handle and a securing tongue having protruding grips extending therefrom and a leading end, and securing means for receiving the leading end comprised of a plurality of locking members for receiving in a secure fashion the protruding grips, whereby the plurality of strings or cleaning elements is fastened to the handle. The assembling of the cleaning elements to the handle is accomplished in a simple, foolproof fashion, wherein the plurality of string is disposed laterally of the securing tongue and its leading end is pulled through a channel formed by the locking members, whereby the protruding grips engage the locking members.

BRIEF DESCRIPTION OF THE DRAWINGS

A detailed description of a preferred embodiment of this invention is hereafter made with specific reference being made to the drawings in which.

DESCRIPTION OF THE PREFERRED EMBODIMENT

Figures 1, 2, 3:
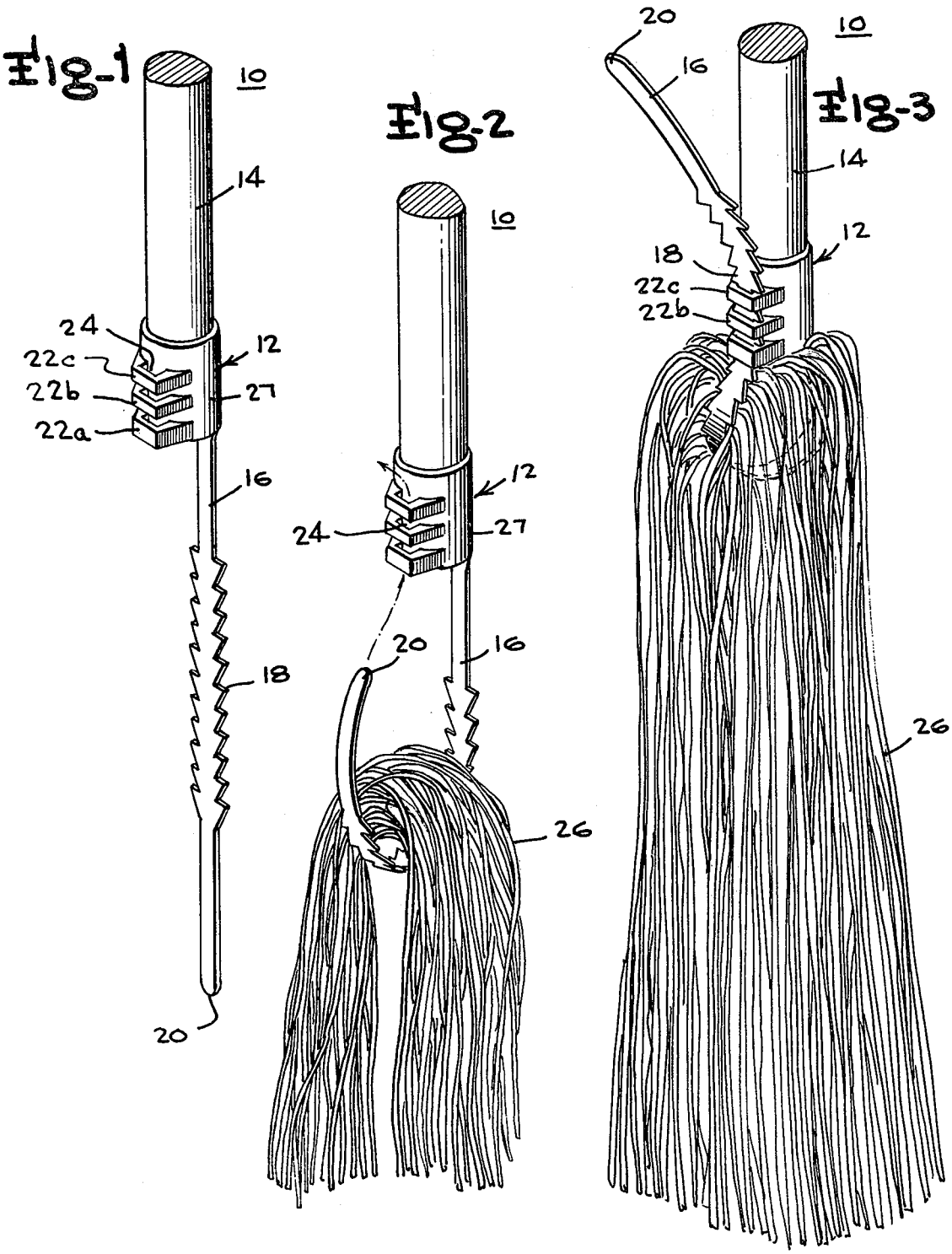
FIGS. 1, 2 and 3 are perspective views of the cleaning device of this invention and particularly illustrate the manner in which a plurality of cleaning elements or strings is secured by a connector to the device's handle.
Figure 4:
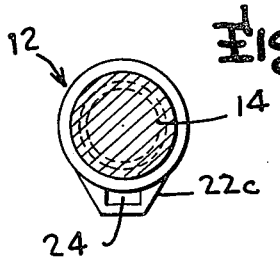
FIG. 4 is a sectioned, plan view taken through the connector of the device, particularly illustrating the manner in which the connector is secured to the handle.
Figure 5:
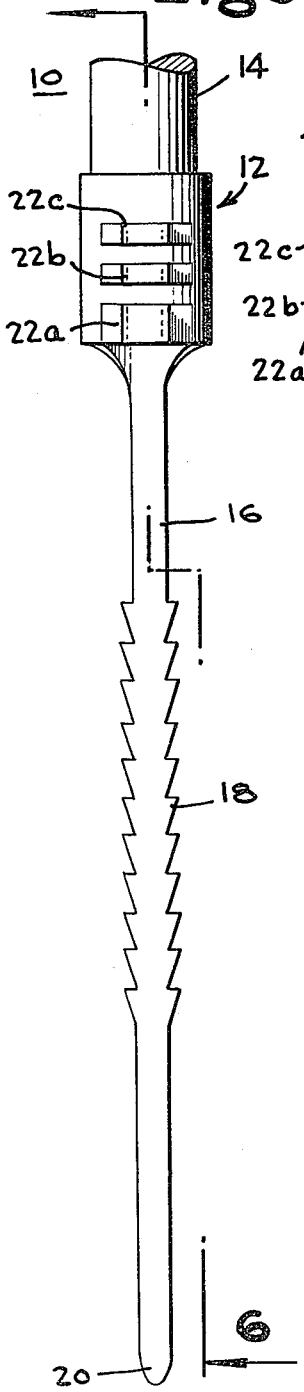
FIG. 5 is a partial, side view of the cleaning device of this invention.
Figure 6:
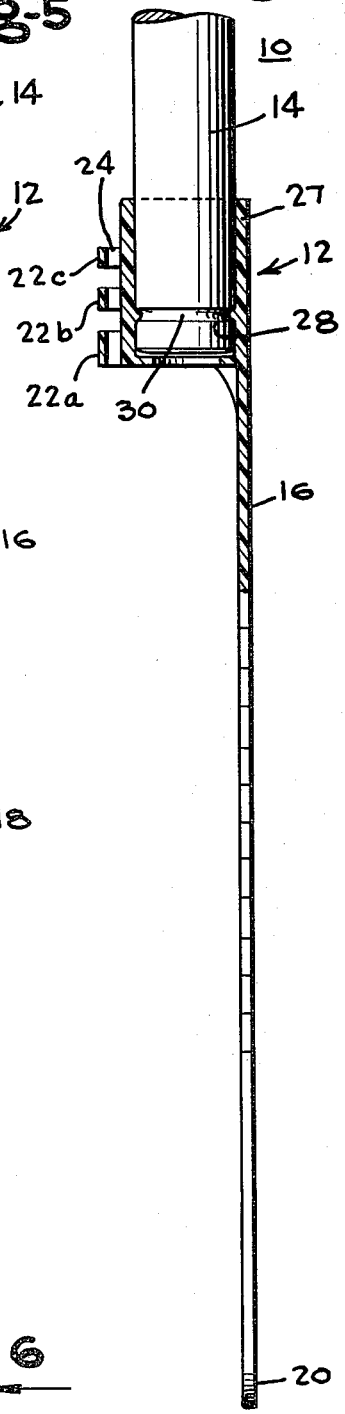
FIG. 6 is a partially sectioned view taken along line 6—6 of FIG. 5.
Figure 7:
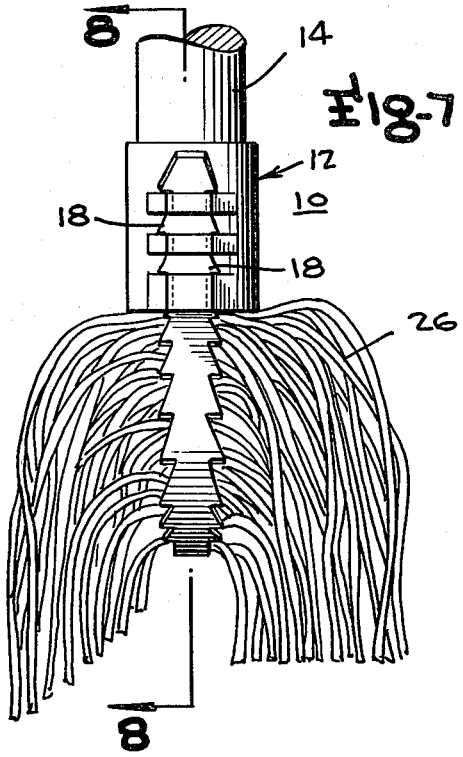
FIG. 7 is a partial side view of the cleaning device of this invention showing the manner in which the securing tongue secures the plurality of elements to the handle.

Referring now to the drawings and in particular to FIG. 1, there is shown a cleaning device 10 in accordance with this invention as comprising a connector 12. As shown in FIG. 3, the connector 12 serves to secure a plurality of cleaning elements or strings 26 to a handle 14. Each of the strings 26 is made of a fabric or yarn that is capable of effecting a dry or wet mop operation. Though other materials could be used, it is suggested that the elements 26 be made of cotton. In an illustrative embodiment of this invention, the connector 12 is made of and in particular, molded of a suitable non-metalic material such as plastic and in particular, of polyethelne. As shown in FIGS. 1 and 6, the connector 12 includes a cylindrically shaped, hollow portion 27 having an axis (not shown) and a securing tongue 16 extending downwardly in a substantially parallel relationship to the axis of the cylindrical portion 27. The securing tongue 16 includes a plurality of protruding grips 18 disposed on either edge of the tongue 16, and a leading end 20. Further, the connector 12 includes locking means taking the form of a plurality of locking members **22*a*, 22*b* and 22*c*. Each of the locking members 22 is integrally molded with the connector 12 to having an opening therein, whereby a channel 24 is formed through each of the locking members 22 as shown more clearly in FIGS. 4 and 6**.

Figure 8:
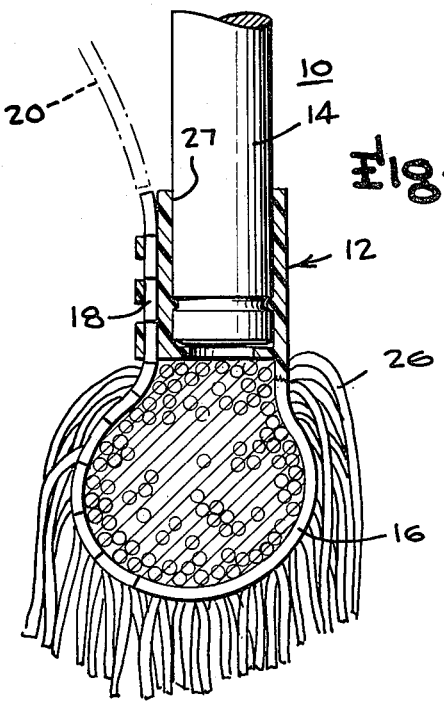
FIG. 8 is a sectioned view taken along line 8—8 of FIG. 7.

As shown particularly in FIGS. 6 and 8, the connector 12 includes a retaining projection 28 disposed upon the inner surface of the cylindrical portion 27 and having a circular configuration. In complementary fashion, the handle 14 has a receiving groove 30 disposed therein a relatively short distance from that end of the handle 14 received within the cylindrical portion 27. The retaining projection 28 is designed to engage the receiving groove 30, whereby the handle 14 is securely affixed to the connector 12. It is contemplated that the handle 14 may be readily secured to the connector 12 by inserting that end of the handle 14 with its receiving groove 30 into the cylindrical portion 27. The cylindrical portion 27 is made of the noted plastic material and has sufficient resiliency to permit the insertion of the handle 14 so that the receiving groove 30 may be engaged with and retained by the retaining projection 28.

A significant aspect of this invention is the manner in which the plurality of cleaning elements 26 are secured in a relatively facile, foolproof manner to the connector 12 and thus its handle 14. As shown in FIGS. 2,3 and 8, a plurality of the cleaning elements 26 is assembled together with their ends approximately aligned with each other, such plurality being disposed laterally across the length of the securing tongue 16 as shown in FIG. 2. In particular, FIG. 2 shows that the securing tongue 16 is bent into a U-shaped configuration to receive the cleaning element 26 and thereafter, its leading end 20 is grasped by the assembler and is disposed within the channel 24. After insertion within the channel 24, the leading end 20 is grasped and is pulled upward as shown in FIG. 3, whereby the protruding grips 18 engage each of the locking members 22. In this regard it is seen that the protruding grips 18 and the locking members 22 are spaced from each other a distance so that upon insertion within the channel 24 that each protruding grip 18 will abut a retaining surface of its locking member 22. In this fashion as shown particularly in FIG. 3, each of a plurality of protruding grips 18 engages the upper surface of its corresponding locking member 22 thereby assuring a secure locking connection between the securing tongue 16 and the locking members 22. As the leading end 20 is pulled in an upward direction as shown in FIG. 3, the cleaning elements 26 are pulled into a secure connection to the connector 12 and thus its handle 14. After the securing tongue 16 has been pulled tight, any excess portion of the leading end 20 may be removed simply by cutting as with a pair of scissors, the excess portion being shown in dotted line in FIG. 8.

Thus there has been shown a cleaning device and in particular a connector whereby a plurality of cleaning elements may be secured in a facile, foolproof fashion to a handle. The connector includes a securing tongue that is disposed around the cleaning elements with its leading end held in a secure fashion by a plurality of locking members each of which engages an protruding grip extending from the edges of the securing tongue. By simply pulling the leading end of the securing tongue, the cleaning elements are pulled into a tight assembly with respect to each other and in a secure relationship to the connector. By making the connector of a suitable plastic material, it is assured that the connector will not corrode or rust, and further will not scratch the surface to be cleaned.

In considering this invention, it should be remembered that the present disclosure is illustrative only and the scope of the invention should be determined by the appended claims.

I claim:

1. A cleaning device comprising:

(a) a plurality of cleaning elements;

(b) a handle having a first end adapted to be manually graspable and a second end; and (c) a connector comprising a portion adapted for receiving said second end for securing said handle to said connector, a flexible securing tongue mounted on said connector and adapted to be disposed directly about said plurality of cleaning elements and having a leading end, and locking means on said connector for adjustably receiving said leading end whereby said securing tongue secures a variable number of cleaning elements to said handle.

2. The cleaning device as claimed in claim 1, wherein said securing tongue includes a plurality of protruding grips extending therefrom.

3. The cleaning device as claimed in claim 2, wherein said locking means comprises a plurality of locking members each having an opening therethrough to form a channel through said locking means for receiving said leading end of said securing tongue.

4. The cleaning device as claimed in claim 3, wherein said locking members and said protruding grips are spaced from each other substantially the same distance, where corresponding ones of said plurality of grips engage corresponding locking members to secure said securing tongue to said locking means.

5. The cleaning device as claimed in claim 1, wherein said securing tongue comprises at least one protruding grip extending therefrom.

6. The cleaning device as claimed in claim 3, wherein said locking means comprises a locking member having a channel therethrough for receiving said leading end, whereby said protruding grip engages said locking member and said plurality of cleaning elements is secured to said connector.

7. The cleaning device as claimed in claim 1, wherein said receiving portion includes a retaining projection and said handle includes a groove for receiving said retaining projection, whereby said handle is secured to said connector.

8. The cleaning device as claimed in claim 1, wherein said connector is made of a non corrosive, elastic material.

9. The cleaning device as claimed in claim 8, wherein said material comprises polyethelene.

* * * * *